United States Patent [19]

Fay

[11] Patent Number: 4,926,686

[45] Date of Patent: May 22, 1990

[54] METHOD FOR DETERMINING THE WEAR OF THE CUTTING MEANS OF A TOOL DURING DRILLING A ROCKY FORMATION

[75] Inventor: Hubert Faÿ, L'Etang La Ville, France

[73] Assignee: Institut Francais du Petrole, Rueil Malmaison, France

[21] Appl. No.: 246,192

[22] Filed: Sep. 19, 1988

[30] Foreign Application Priority Data

Sep. 17, 1987 [FR] France ..... 8712928

[51] Int. Cl.[5] ..... E21B 44/00

[52] U.S. Cl. ..... 73/151; 175/39

[58] Field of Search ..... 73/151, 151.5; 175/39, 175/40; 166/250

[56] References Cited

U.S. PATENT DOCUMENTS

| | | | |
|---|---|---|---|
| 3,782,190 | 1/1974 | Pittman | 175/39 |
| 4,627,276 | 12/1986 | Burgess et al. | 175/39 |
| 4,685,329 | 8/1987 | Burgess | 73/151 |
| 4,695,957 | 9/1987 | Peltier | 73/151 |

*Primary Examiner*—Hezron E. Williams
*Assistant Examiner*—Kevin D. O'Shea
*Attorney, Agent, or Firm*—Antonelli, Terry & Wands

[57] ABSTRACT

A method for determining the wear of cutting portion of a tool during drilling of a formation wherein a measurement is taken of the weight W applied to the tool and the torque T required to rotate said tool, the weight on the tool W and the torque T being linked by an equation of the type $T = uW + vW^{\alpha}$ in which u and v are parameters and $\alpha$ is a coefficient depending in part on the formation.

8 Claims, 2 Drawing Sheets

METHOD FOR DETERMINING THE WEAR OF THE CUTTING MEANS OF A TOOL DURING DRILLING A ROCKY FORMATION

FIELD OF THE INVENTION

The present invention relates to a method for determining the wear of cutting means of a tool during drilling a formation.

BACKGROUND OF THE INVENTION

The techniques for drilling oil wells have considerably advanced during the last ten years or so and have therefore resulted in a new development of drilling tools used for cutting rocks.

The drilling tools used mostly in this field are bits, namely those of roller bit type which crush, chip fracture and scarenge the rock when the drill string is being rotated. However, these bits have relatively a short lifetime of from 15 to 20 hours and it is useful to check their wear so as to provide for their replacement. Problems of wear also exist in the case of P.D.C. (Polycrystalline Diamond Compact) bits, but the problem here is less critical.

A method is already known via the U.S. Pat. No. 4,627,276 on how to determine the mean values of the penetration rate of a drilling tool of the rotary speed and weight on bit so as to deduce drilling efficiency and the shearing strength of the tock where drilling is carried out.

The patent EP-A 0,168,996 shows for its part a device for detecting events during drilling as more particularly failure on drilling tools.

However, none of these documents offers a method for determining the progressive wear of cutting means, such as in particular the teeth of a roller bit. The method of the present invention, simple and convenient to operate, uses the measurement of two basic parameters, namely the weight on the tool W and the torque on the bit T, and the degree of wear can be obtained at any moment by the operator whenever he so wishes.

SUMMARY OF THE INVENTION

The aim of the present invention is to offer a method for determining the wear of cutting means of a tool during drilling a formation, by which the weight W applied to the tool and the torque T required to rotate said tool is measured, the weight on the tool W and the torque T being linked by an equation of the type $T=uW+vW^{\alpha}$ in which u and v are parameters and $\alpha$ is a coefficient dependent, apart from other things, on the formation, wherein:

a series of weight values is applied on the tool in drilling during a first test period, a first measurement series is carried out at the down hole on the torque and the weight on tool during a first test period, on the basis of said first measurement series, a curve portion representative of the torque variations according to the weight variations is drawn up, said portion of the curve drawn up during the first test period is recorded, whilst drilling continues, a series of test periods is carried out, said corresponding representative curve portion being drawn up for each said period, the curve portion obtained for a given test period is compared with at least one curve portion previously obtained, the degree of the wear of the cutting means is deduced from this according to the variation of at least one magnitude linked to said curve portions.

As claimed in one preferred mode of embodiment of the present invention, said first measurement series from which the first curve portion is obtained is effected on a new tool not presenting any wear.

Advantageously, the magnitude dependent on the representative curve portions where the wear of cutting means is deduced is linked to the concavity of said curves.

So as to overcome measurement inaccuracies having repercussions on the concavity, the quantity linked to said curve portion depends on the means bending radius value of said curve portion. By using a mean bending radius, the curve portion obtained can be regarded as being more representative of actual wear.

According to one particular embodiment of the invention, for a given test period at least one function of the parameter v is determined from firstly said portions of curves linked to the preceding test periods and secondly the equation $T=uW+vx$, and the degree of the wear of the cutting means of the tool is deduced by the decrease of said function of the parameter v.

Advantageously, a step by step sweeping of the value of the weight on the tool around its reference value is carried out and the corresponding values of W and T are determined during this scanning.

The object of the present invention also comprises a device to determine the wear of the cutting means of a tool when drilling a rocky formation, comprising instruments at the bottom of the well to measure the weight W on the tool and the torque T required to rotate said tool, means to apply a weight onto the tool during a test period, wherein it includes means to transmit the measurements of the weight and the torque to a processing unit which converts said measurements into a curve representative of the variations of the torque according to the variations of the weight, means to memorize said curve representative for a given test period, means to compare the various representative curves linked to successive test periods, and means to calculate the degree of wear on the basis of the variation of a magnitude linked to said representative curves.

Advantageously, the processing unit is integrated into a computer located on the surface.

BRIEF DESCRIPTION OF THE DRAWINGS

The invention shall be more readily understood by referring to the description corresponding to the annexed figures in which:

FIGS. 3 and 4 show representative curves of the torque (T) according to the weight applied on the tool (W) and.

Figure 1:
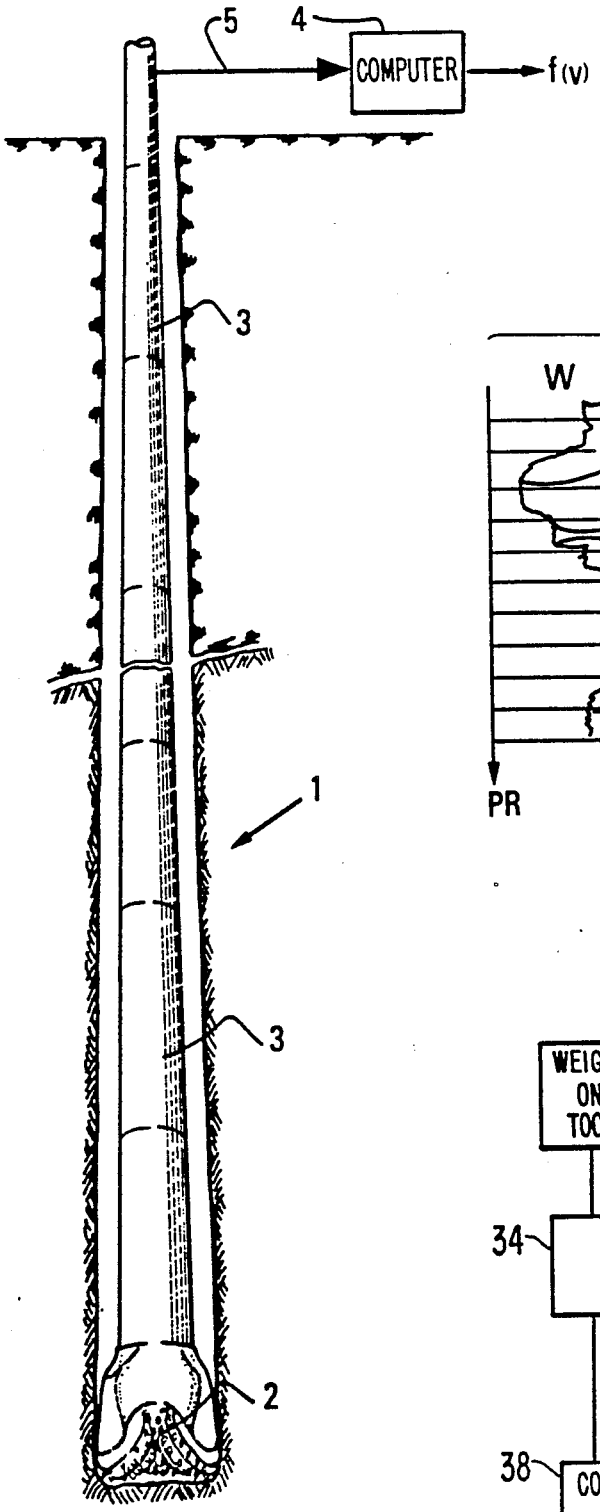
FIG. 1 diagrammatically shows a method to obtain the wear criterion of bit according to weight applied on the tool W and the torque exerted on the tool T.

The invention makes it possible to determine the wear of cutting means, such as, in particular, the teeth of a tool. Thus, it applies to roller bits with milled teeth and insert bits to drilling tools presenting a relation of the same type of the torque (T) applied according to the weight (W), this being the case, for example, with P.D.C. (Polycrystalline Diamond Compact) tools.

The present invention makes it possible to determine the wear of the tool from measuring the torque on the tool and the weight on the tool.

The variation of the torque on the bit has already been used in several methods for determining events, such as defects at the level of the bearings.

This particularly is the case in the patent n EP-A 0,168,996 which states that these two parameters may depend on each other according to the equation:

$$T=uW+vW^2$$

More generally, this equation may be written as follows:

$$T=uW+vW^{\alpha} \quad (1)$$

with $\alpha$ coefficient dependent, in relation to another parameter, on the formation and whose value may be taken as equal to 2.

However, the developments of this method in accordance with the present invention concern a calculation relating to a limited set of the values recorded which include determining the parameters u and v.

So as to properly understand the invention, a theoretical approach will next be described.

Reference should be made to the following publications:

H. W. R. Wardlaw—Optimization of Rotary Drilling Parameters—Dissertation—University of Texas, 1971.

T. M. Warren—Factors Affecting Torque for a Tricone Bit—S.P.E. 11 994—1983.

P. F. Gnirk and J. B. Cheatham—A Theoretical Description of Rotary Drilling for Idealized Down-Hole Bit-Rock Conditions—S.P.E. Journal, Dec. 1969.

First of all, a certain number of the following notations used are defined:

Lateral compression of rock prior to fracture

C1: half-width of the teeth of the drilling tool (at penetration depth)

D: Diameter of the tool

E: Young's module of the formation m: Dimensionless constant (function of the type of formation)

N: Rotary speed of the tool n: Flat part of worn teeth

P: Differential pressure across hole bottom

Q: Mud flowrate r: Distance of a stone chip in relation to tool axis.

R: Radius of bit cone

S: Shear strength of rock upon rupture

T: Torque on tool

V: Speed of mud of hydraulic bit action $V_A$: Instantaneous penetration rate

W: Weight on the tool

Z: Mass density of drilling fluid $\alpha$: Weight exponent in the equation $T=uW+vW^{\alpha}$ $\gamma/2\pi$: Fraction of bottom area cut per revolution $\delta$: Penetration of teeth in formation $\eta$: Efficiency factor for hydraulic lifting of chips level $\gamma v2\pi$: Fraction of bottom area supporting the weight W $\mu$: Viscosity of drilling fluid $\theta$: Angle subtended from horizontal by chip fracture plane.

By using Wardlas' hypotheses and by integrating the elementary torque along the radius r, the expression of the overall torque T is expressed as follows:

$$T=\frac{s\delta}{\mathrm{Cos}\theta\ \mathrm{Sin}\theta}\ \frac{D^2}{8} \quad (2)$$

Moreover, by calling $\gamma_1/2\pi$ the fraction of bottom area corresponding to rock chips being freed from the differential pressure P and by similarly calling the one corresponding to chips crushed under equipressure, namely $\gamma_3/2\pi$ where the effect of the mud flow rate Q and the efficiency factor of the mud $\eta$ are preponderant, namely $\gamma_2 2\pi$, the mean penetration of the teeth $\delta$ is given by:

$$\delta=\frac{2\pi}{\gamma_1+\gamma_i}\ \frac{V_A}{N} \quad (3)$$

with i=2.3 according to the mode of operation in question in which:

$$T=\frac{2\pi}{\gamma_1+\gamma_i}\ \frac{1}{\mathrm{Sin}\theta\ \mathrm{Cos}\theta}\ \frac{SD^2}{8}\ \frac{V_A}{N} \quad (4)$$

and by replacing $V_A$ by its expression according to the drilling mode considered by Wardlaw, the expressions of the torque may be written:

$$T_1=\frac{8}{\lambda^2}\ \frac{C_1}{D}\ \frac{\gamma_1}{\gamma_1+\gamma_2}\sin^2\beta/2\ \sin\beta\ \frac{1}{DP}\left(\frac{W^2}{1+\frac{128}{\lambda^2}\ \frac{\gamma_1}{\gamma_2}\ \frac{\sin^2\beta/2\ \sin\beta}{tg\theta}\ \frac{W^2}{PED^4}}\right) \quad (5)$$

$$T_2=\frac{8}{\lambda^2}\ \frac{C_1}{D}\ \frac{\gamma_1}{\gamma_1+\gamma_2}\sin^2\beta/2\ \sin\beta\ \frac{1}{DP}\left(\frac{W^2}{1+\frac{C_1}{D}\ \frac{4\gamma_1\gamma_3\eta}{\pi\lambda^2}\ \frac{\sin^2\beta/2\ \sin\beta\sin 2\theta}{QZV^2}\ \frac{NW^2}{SD}}\right) \quad (6)$$

$$T_3=\frac{8}{\lambda^2}\ \frac{C_1}{D}\ \frac{\gamma_1}{\gamma_1+\gamma_2}\ \frac{\sin^2\beta/2\ \sin\beta}{\mu m}\ \frac{1}{ND}\left(\frac{W^2}{1+\frac{128}{\lambda^2}\ \frac{\gamma_1}{\gamma_2}\ \frac{\sin^2\beta/2\ \sin\beta}{\mu m\ tg\theta}\ \frac{W^2}{END^4}}\right) \quad (7)$$

in the equation 7, m is a dimensionless constant, dependent on the nature of the formation.

By taking the example of the first mode of operation (equation 5), it is possible to demonstrate that the bending radius of the representative curve increases when the tool is wearing and thus that the term v of the equation 1 decreases.

In fact, the equation 5 can be written:

$$T = I\frac{W^2}{1 + J W^2} \quad (8)$$

and if it is placed along this curve below the reversal point, i.e. for $$W < \frac{1}{\sqrt{3J}},$$

the bending radius is given by:

$$\rho\# \frac{\left(1 + 4\frac{T^2}{W^2}\right)^{3/2}}{2I} \quad (9)$$

Knowing that the value of the ratio T/W is generally less than 1, the variation of $\rho$ when the tool is wearing mainly depends on that of I. Now:

$$I = \frac{8}{\lambda^2}\ \frac{C_1}{D}\ \frac{\gamma_1}{\gamma_1 + \gamma_2}\sin^2\beta/2\ \sin\beta\ \frac{1}{DP} \quad (10)$$

Gradually as the wear of the teeth $\delta$ (equation 14) decreases, therefore $C_1$ decreases as well since:

$$C_1 = \delta tg\ \beta/2 \quad (11)$$

in other respects, the value of $\lambda$ increasing, I can only decrease, $\rho$ increases and therefore v decreases correlatively.

Similarly, Warren proposes as an equation of the torque on the tool:

$$T = \sin\theta'\frac{2W}{D}\int_O^{D/2}\left(K_1 + \sqrt{\frac{2\delta}{R}}\right)xdx \quad (12)$$

$K_1$ being a constant, for a given tool, according to the offset of the roller cones in relation the tool axis, R the usual radius of the roller cone and $\theta'$ the explementary angle of the half angle at the top of the same roller cones.

The integration of the equation (12) leads to the equation (13):

$$T = D\sin\theta'\left(\frac{K_1}{4} + \frac{1}{3}\sqrt{\frac{2\delta}{R_O}}\right)W \quad (13)$$

knowing that the penetration $\delta$ is linked to the weight on the tool according to Cheatham and Gnirk by the equation:

$$\delta = \left(\frac{W}{\sigma} - K_2 n\right)\frac{1}{K_3} \quad (14)$$

with:

$K_2$ and $K_3$, as parameters according to the geometrical characteristics of the teeth, the internal friction angle of the formation and, to a lesser extent, the rotary speed N.

$\sigma$, the compressive stress at the differential pressure P.

$\eta$, the flat part width of the worn teeth.

The equation (14) is written:

$$T = D\sin\theta'\left(\frac{K_1}{4}W + \frac{W}{3}\sqrt{\frac{2}{R_O K_3}}\sqrt{\frac{W}{\sigma} - K_2 n}\right) \quad (15)$$

Thus for one tool, one formation, and given drilling and hydraulic conditions, when the tool wears n increases and, with the equation (5) showing that the concavity of the representative curve decreases in this case, the value of the parameter v of the equation:

$$T = uW + vW^{\alpha}$$

also decreases.

Therefore, according to the method of the present invention, the degree of the wear of a tool is evaluated by means of a criterion or magnitude linked to the average concavity depending on the value of parameter v defined by the equation:

$$T = uW + vW^{\alpha}$$

an equation in which u and v are two parameters according to the type of tool, the formation, hydraulic conditions, and the rotary speed of the tool, and where $\alpha$ is a coefficient of numerical value, generally close to 2.

So as to support the theorical conclusion, experimental studies carried out on test benches have confirmed and even quantified the effect of the wear of the teeth concerning the value of the parameter v.

The test conditions were:

diameter of bits : 0.152 m (6")
formation : Buxy limestone
rotary speed : 116 rpm
cinfining pressure : 90 bars
flow rate of mud in water : 400 l/min.

The results obtained have enabled the following curves to be plotted $$T = uW + vW^{\alpha} \text{ where } \alpha = 2$$

by regression by using the least error squares method.

Figure 3:
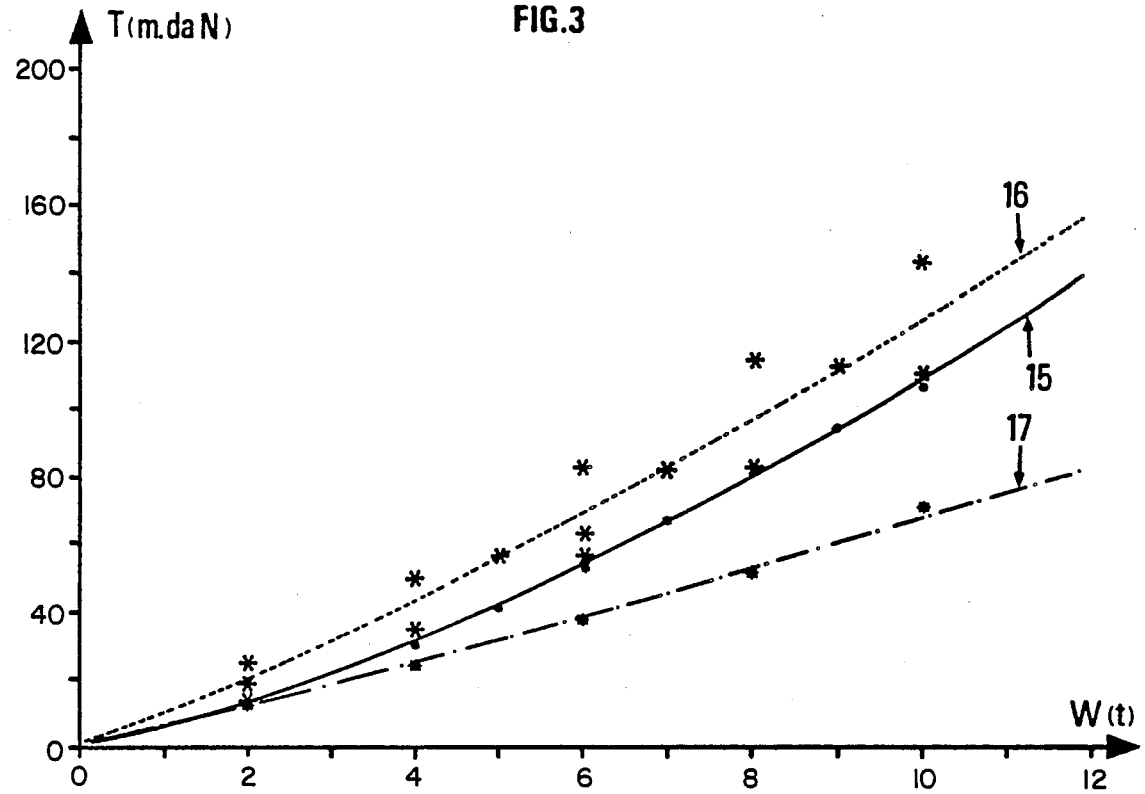

These curves are shown in FIG. 3.

DETAILED DESCRIPTION OF A PREFERRED EMBODIMENT

Thus FIG. 3 indicates the reduction of the value of v for a given type of bit (J3D), according to 3 different degrees of wear (new bit, T4 and teeth graded full wear of teeth T8) with, because of the choice of non-standardized units:

$$u^* = 10^3\ u$$

$$v^* = 10^7\ v$$

FIG. 3 represents the experimental curves 15, 16, 17 of the torque (T) according to the weight on the tool (W). The curve 15 corresponds to a new tool and the curve 16 corresponds to the same type of tool J3D with a teeth graded T4 (the designation of the tool in this state being: J3DT4).

The curve 17 corresponds to the same type of tool with a degree of wear T8 (the tool in this state being designated by J3DT8).

The abscissa in FIG. 3 represents the weight applied on the tool, expressed in tons and the ordinate, the torque T expressed in 10N.m (10 Newton meters). The term, Newton meter, expresses the intensity of a moment.

For each curve, table 1 specifies the tool designation and the values of u* and v*.

TABLE 1

| CURVE | BIT DESIGNATION | u | v |
|---|---|---|---|
| 15 | J3DN | 5.8 | 0.5 |
| 16 | J3DT4 | 9.4 | 0.3 |
| 17 | J3DT8 | 6.1 | 0.06 |

Thus, it obviously seems that v decreases when the tool wear increases. An examination of the curves clearly shows that it is curve 15 which has the largest concavity.

It is therefore established that, for a drilling whose hydraulic drilling conditions and the boring rotary speed slightly vary and whose lithology of the formations traversed is not radically diversified, the value of v progressively decreases as the tool wears out. It is therefore possible to regard this value or any other function of v as representing a wear criterion of the tools.

If the other hand the aforesaid conditions vary significantly, it is appropriate to allocate v with a weighting function factor of the preceding variations whose effect can be determined by the equations (5), (6), and (7) and/or by reference tests.

There follows a description of the present invention relating to its practical embodiment on the drilling site and especially its implementation for determining the wear of cutting means.

FIG. 1 diagrammatizes the environment allowing the value of criterion v or f(v) to be obtained, the function f corresponding to an additional processing of the parameter v, for example to provide the operator with the results in a simple way.

The invention mainly requires a knowledge of the two basic parameters, the weight on the tool (W) and torque on the tool (T).

So as to examine the torque variations on the tool, a weight sweeping step by step is carried out on the bit. The sweeping range and the number of steps must be sufficient. The duration of each weight step is determined by establishing a stabilized measurement.

In FIG. 1 the reference 1 represents a well drilled with a drilling tool of threecone bit type 2 fitted to the extremity of a drilling string 3.

The weight and torque applied on the tool 2 measurements can be transmitted to the surface, for example by the drilling fluid channel, or by any other means (electric cable, etc.) and to the computer 4 by a transmission represented by the arrow 5.

The computer supplies the operator with the value of the wear criterion according to the invention.

Figure 2:
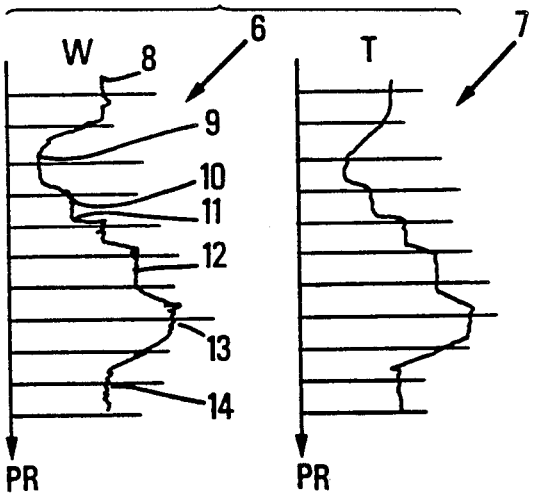
FIG. 2 is a diagrammatic representation of the recordings carried out according to the measurements of the parameters T and W.

Each time the operator wants to know the value of the wear criterion, he starts from the surface the test procedure represented on FIG. 2. The values of T and W are then recorded, processed and exploited by the computer.

FIG. 2 represents side by side an evolution curve 6 of the weight W applied on the tool according to the depth PR and an evolution curve 7 of the torque T exerted on the tool according to the depth PR. The depth scales PR of the curves 6 and 7 are identical and mutually correspond to each other.

The measurements of the weight and the torque applied on the tool can be carried out in a manner known by someone skilled in the art, for example by means of the method known as the M.W.D. ("Measurement While Drilling") method. The variation of the weight applied on the tool can be obtained in a conventional way by more or less supporting the drill string from the surface.

The measurements of the parameters are made in accordance with the depth and/or the time. It is recommended that at least 5 steps per test period are able to be carried out, which results in an overall test period of about fifteen minutes.

FIG. 2 diagramatically represents a test period comprising five steps.

The level of the step 8 corresponds to the weight on the tool during drilling on the basis of which the operator decides to start the test. The test includes a reduction of the weight on the tool so as to arrive at the step 9 then a rise in four other steps respectively 10, 11, 12 and 13 corresponding to an increase of the weight on the tool.

During this variation of the weight on the tool, the variation of the torque T exerted on the tool (curve 7) are recorded and at the end of the fifth bearing 13, it then being possible to return to the level of the step 14 which is sensibly equal to the weight on the drilling tool before starting the test and which thus corresponds approximately to the step 8. Subsequently, it is possible to return to another step corresponding to the optimal conditions for using the drill tool, having regard to of its wear grade which has just been determined. The first test shall be carried out, the tool being at the start of the run. The number of the following tests depends on the choices of the operator.

The first series of measurements made at the bottom of the well on the level of the tool concerning the torque and weight correspond to the start of the rock being attacked by the tool, namely that its wear may be regarded as virtually nil.

The series of measurements carried out during the first test period is transmitted on the surface to the computer which establishes from this data a curve portion representative of the torque variations according to the variations of the weight. The computer then stores this curve corresponding to the test period.

Whenever he so wishes, the operator starts a new test period provoking a variations for each step of the weight applied on the tool, the computer again receiving a new series of measurements from which he can determine the curve representative of the variations of T according to W.

The degree of wear could then be deduced in two ways:

by comparing the family of curves: any reduction of the curve concavity shall indicate an increase of the wear of the tool. In fact, these curves could be geometrically plotted and thus transmitted to the operator who shall calculate from this the degree of wear, but it is easily possible to envisage that the comparison of the concavity of the curves can be directly carried out by the computer without needing a displayed graphical representation.

by calculating the parameter v; with the curves experimentally obtained verifying the equation $T=uW+vW^{\alpha}$, it is possible to calculate on the basis of the measurements made the value of v. The increase of the wear of the tool is deduced from reduction of this value of v.

Figure 5:
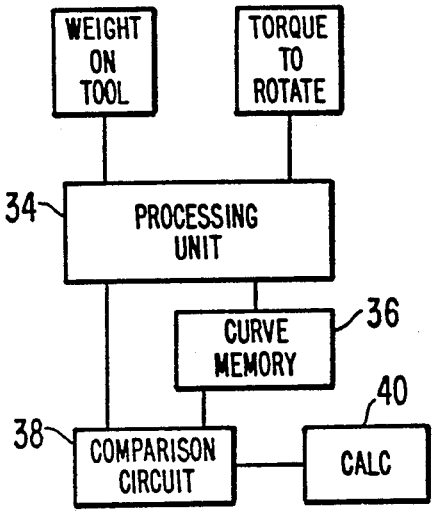
FIG. 5 is a block diagram of a device for determining wear of the cutting portion of a tool during drilling in accordance with the present invention.

The method may be carried out by a device illustrated diagrammatically in FIG. 5 which includes instruments at the well bottom for measuring the weight W on the tool as indicated by block 30. The torque required to rotate the tool is measured as indicated by block 32. Both the weight on the tool and the torque required to rotate the tool can be varied in accordance with normal procedures. Signals proportional to weight and torque are then applied as inputs to a processing unit 34 which produces a signal that is stored in curve memory unit 36. In successive test periods, similar data is measured by the processing unit 34 and compared with the data stored in curved memory unit 36 by a comparing circuit 38 whose output is applied to calculator 40 which allows for the calculation of the degree of wear on the basis of the variation of the values related to the curves taken at different intervals.

Of course, the measurements at the bottom of the well may exhibit some inaccuracies and, on the basis of these measurements, it would therefore be advisable to determine a mean curve, for example by means of the least error squares method, and to deduce from this the mean concavity of this curve represented by the mean bending radius or a quantity linked to this mean value. Then the wear can be determined, either by controlling the evolution of the mean concavity according to the advance of drilling, or by forming the mean concavity with mean concavities established during reference tests.

In the case where the value of the weight on the tool at the bottom can be obtained accurately from a surface measurement, particularly in the case of vertical wells, this surface measurement can be subsequently used within the scope of the present invention.

The characteristics of the formation, the tool, the values of the hydraulic conditions and of N can be taken into consideration so as to standardize the value of the parameter v and/or that of the criterion.

Figure 4:
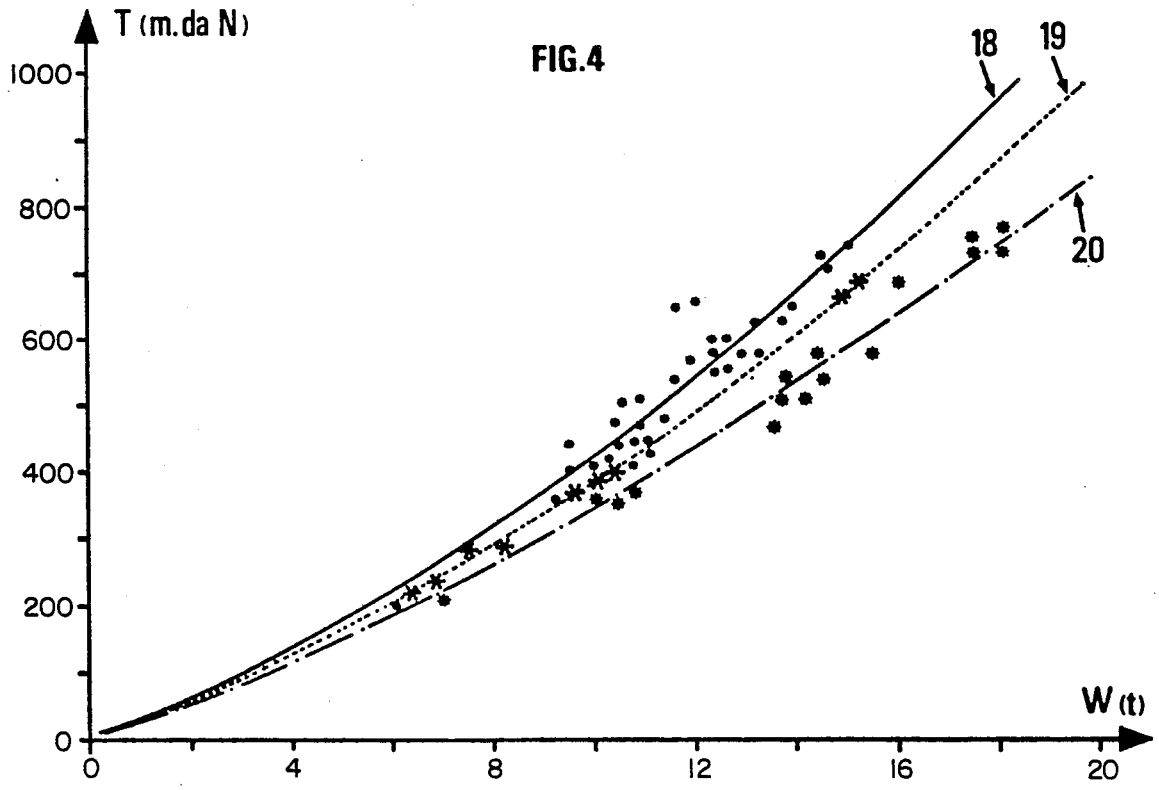

The results obtained on a drilling site are shown in FIG. 4. These results correspond to a well drilled for the Société Nationale Elf Aquitaine off Holland. In contrary to the bench tests previously presented, the tool had a large diameter (17"½). The wear, after a drilling run from a depth of 1306 m to a depth of 1673 m, was equal to T2. The three groups of measurements effected were distributed respectively on 27 m, 3.5 m and 7.5 m.

Although in this case the tool wear is of a minor degree, the value of v actually takes place.

The abscissa in FIG. 4 corresponds to the weight applied on the tool in tons and the ordinate to the torque exerted on the tool in 10N.m.

The curve 18 is placed between the depths 1320 and 1347 m, the curve 19 between the depths 1460 and 1463.5 m and the curve 20 between the depths 1559 and 1566.5 m.

During this test, the tool passed from being new to the wear grade T2, namely indicating a small degree of wear.

The following table indicates for each curve test depth the value of u* and the value of v*.

TABLE 2

| CURVE | TEST DEPTH (m) | u* | v* |
|---|---|---|---|
| 18 | 1320 to 1347 | 29 | 1.37 |
| 19 | 1460 to 1463.5 | 27 | 1.20 |
| 20 | 1559 to 1566.5 | 26 | 0.87 |

Thus it appears that for a small degree of wear the value of v (and consequently of v) has varied significantly, which indicates that the method according to the invention makes it possible to know precisely the degree of the wear of the tool.

The points shown on FIGS. 3 and 4 correspond to the values used to establish the different curves. It not necessary to plot the curves during different tests. It is merely necessary to obtain the value of v or a function of v to know the state of the wear of the tool. Of course, it is advisable that the operator has at his disposal a graphic representation of the measurement points and the corresponding curves.

Both the different curves and the values of u have been given so as to make this readily comprehensible by the person skilled in this art.

The method according to the present invention makes it possible to avoid drilling with worn out tools or to pull out somewhat worn bit too soon up to the surface. Awareness of the degree of wear of tools makes it possible to directly reduce the cost of drillings.

What is claimed is:

1. A method for determining the wear of cutting means of a tool during drilling a rock formation, wherein the weight W applied to the tool and the torque T required to rotate said tool is measured, the weight on the tool W and the torque T being linked by a relation of the type $T=uW+vW^{\alpha}$, wherein u and v are parameters and $\alpha$ is a coefficient depending amongst other things on the formation, wherein:

a series of values of the weight is applied on the tool in drilling during a first test period, a first series of measurements is carried out at the down hole on the torque and weight on tool during the first test period, on the basis of said measurement series, a curve portion representative of the variations of the torque according to the variations of the weight is drawn up, said curve portion established during the first test period is stored, during drilling advance, carrying out a series of test period to establish a curve portion for each period, comparing the curve portion obtained during one of said test periods with at least one curve portion previously stored, and calculating the degree of wear of cutting means according to the variation of at least one magnitude related to the comparison of said curve portions.

2. A method for determining wear according to claim 1, wherein said first measurement series from which first curve portion is obtained is carried out on a new tool.

3. A method for determining wear according to the claim 1, wherein the magnitude dependent on the representative curve portions from which wear id deduced on the cutting means is related to the concavity of said curves.

4. A method for determining wear according to the claim 1, wherein the magnitude linked to said curve portions depends on the value of the mean bending radius of said curve portion.

5. A method for determining wear according to claim 1, wherein for a given test period at least one function of the parameter v is determined from firstly said curve portions achieved from the preceding test periods and secondly from the relation $T=uW+vW^{\alpha}$ and wherein the degree of wear of the tool cutting members is deduced by the decrease of said function of the parameter v.

6. A method for determining wear according to any one of the claims 1 to 5, wherein a sweeping step by step of the value of the weight on the tool around to its reference value is effected and the corresponding values of W and T during this sweeping are determined.

7. A device for determining wear of the cutting means of a tool during drilling a formation, comprising instruments at the well bottom for measuring the weight W on the tool and the torque T required to rotate said tool, means for applying a weight on the tool during a test period, wherein device comprises means for transmitting the weight and torque measurements to a processing unit which converts said measurements into a curve representative of the torque variations according to the variations of the weight, means for memorizing said representative curve for a given test period, means for comparing different representative curves corresponding to successive test periods, and means for calculating the degree of wear on the basis of the variation of a valve corresponding to said representative curves.

8. A device for determining wear according to claim 7, wherein the processing unit is connected to a computer located on the surface.

* * * * *